US006671344B2

(12) United States Patent
Matsunaga et al.

(10) Patent No.: US 6,671,344 B2
(45) Date of Patent: Dec. 30, 2003

(54) CLOSED VESSEL FOR RADIOACTIVE SUBSTANCE, SEAL-WELDING METHOD FOR CLOSED VESSEL, AND EXHAUST SYSTEM USED FOR SEAL-WELDING METHOD

(75) Inventors: Kenichi Matsunaga, Kobe (JP); Ganji Abe, Kobe (JP); Kazuo Murakami, Kobe (JP); Koichi Ue, Kobe (JP); Takashi Shige, Takasago (JP); Etsuryo Kita, Kobe (JP); Shizuo Inoue, Kobe (JP); Tsuneo Mandai, Kobe (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 18 days.

(21) Appl. No.: 10/178,743

(22) Filed: Jun. 25, 2002

(65) Prior Publication Data

US 2003/0002614 A1 Jan. 2, 2003

(30) Foreign Application Priority Data

Jun. 29, 2001 (JP) ..... 2001-200174

(51) Int. Cl.[7] ..... G21F 5/008
(52) U.S. Cl. ..... 376/272; 250/506.1; 250/507.1
(58) Field of Search ..... 376/272; 250/506.1, 250/507.1

(56) References Cited

U.S. PATENT DOCUMENTS

| | | | | | |
|---|---|---|---|---|---|
| 3,327,892 | A | * | 6/1967 | Lloyd et al. | 220/612 |
| 3,754,141 | A | * | 8/1973 | Leebl et al. | 250/507.1 |
| 3,770,964 | A | * | 11/1973 | Backus | 250/506.1 |
| 3,953,288 | A | * | 4/1976 | Johnson | 376/456 |
| 4,078,811 | A | * | 3/1978 | Bock et al. | 138/96 R |
| 4,187,410 | A | * | 2/1980 | Eroshkin et al. | 219/137.2 |
| 4,197,467 | A | * | 4/1980 | Williams | 250/506.1 |
| 4,274,007 | A | * | 6/1981 | Baatz et al. | 250/506.1 |
| 4,278,892 | A | * | 7/1981 | Baatz et al. | 250/506.1 |
| 4,320,847 | A | * | 3/1982 | Gesser et al. | 220/610 |
| 4,445,042 | A | * | 4/1984 | Baatz et al. | 250/506.1 |
| 4,508,969 | A | * | 4/1985 | Janberg et al. | 250/506.1 |
| 4,527,065 | A | * | 7/1985 | Popp et al. | 250/506.1 |
| 4,535,250 | A | * | 8/1985 | Fields | 250/507.1 |
| 4,594,214 | A | * | 6/1986 | Popp et al. | 376/272 |
| 4,596,688 | A | * | 6/1986 | Popp | 376/272 |
| 4,673,814 | A | * | 6/1987 | Schroeder et al. | 250/506.1 |
| 4,702,391 | A | * | 10/1987 | Koester et al. | 250/507.1 |
| 4,738,388 | A | * | 4/1988 | Bienek et al. | 228/135 |
| 4,818,878 | A | * | 4/1989 | Popp et al. | 250/507.1 |
| 4,847,009 | A | * | 7/1989 | Madle et al. | 588/16 |
| 4,872,563 | A | * | 10/1989 | Warder et al. | 53/471 |
| 4,883,637 | A | * | 11/1989 | McDaniels, Jr. | 376/272 |
| 4,976,912 | A | * | 12/1990 | Madle et al. | 376/249 |
| 5,346,096 | A | * | 9/1994 | Diersch et al. | 220/679 |
| 5,391,887 | A | * | 2/1995 | Murray, Jr. | 250/506.1 |
| 5,442,186 | A | * | 8/1995 | Walker et al. | 250/506.1 |
| 5,651,038 | A | * | 7/1997 | Chechelnitsky et al. | 376/272 |
| 5,777,343 | A | * | 7/1998 | Rasel et al. | 250/506.1 |
| 6,058,154 | A | * | 5/2000 | Chanzy et al. | 376/272 |

FOREIGN PATENT DOCUMENTS

| | | | |
|---|---|---|---|
| EP | 0131177 | * | 1/1985 |
| FR | 748526 | * | 9/1970 |
| GB | 2009657 | * | 6/1979 |
| WO | WO 94/18680 | * | 8/1994 |

* cited by examiner

*Primary Examiner*—Michael J. Carone
*Assistant Examiner*—John Richardson
(74) *Attorney, Agent, or Firm*—Oblon, Spivak, McClelland, Maier & Neustadt, P.C.

(57) ABSTRACT

A primary lid is set in a top opening of a vessel body that contains radioactive substance, and closes the top opening. The peripheral edge portion of the primary lid is welded to the inner peripheral surface of the vessel body. As the primary lid is welded, steam in the vessel body is discharged to the outside through a discharge hole in the primary lid, and a shield gas is filled into or run through a space in the outer peripheral portion of the primary lid, so as to prevent the steam from flowing into the welding portion.

5 Claims, 5 Drawing Sheets

CLOSED VESSEL FOR RADIOACTIVE SUBSTANCE, SEAL-WELDING METHOD FOR CLOSED VESSEL, AND EXHAUST SYSTEM USED FOR SEAL-WELDING METHOD

CROSS-REFERENCE TO RELATED APPLICATIONS

This application is based upon and claims the benefit of priority from the prior Japanese Patent Application No. 2001-200174, filed Jun. 29, 2001, the entire contents of which are incorporated herein by reference.

BACKGROUND OF THE INVENTION

1. Field of the Invention

The present invention relates to a metallic closed vessel, or a so-called canister, in which a radioactive substance that involves heat release is sealed, a seal-welding method for the closed vessel, and an exhaust system used for the seal-welding method.

2. Description of the Related Art

Highly radioactive substances represented by spent fuels from nuclear reactors are destructured and reprocessed in order to recover plutonium or some other useful substances that can be used again as fuels. These spent fuels are contained in closed places before they are reprocessed. Known containing methods for these highly radioactive substances include a wet method that uses storage pools and the like and a dry method that uses casks and the like.

The dry method is a containing method in which air is used in place of water for natural cooling. Since the running costs of the dry method are lower than those of the wet method, the dry method has started to attract attention and be developed. Known casks that are applicable to the dry method include metallic casks and concrete casks based on a concrete structure for shielding the spent fuel. Each of these casks is provided with a tubular vessel body that is closed at both ends, top and bottom. The spent fuel is sealed in a tubular metallic closed vessel or a so-called canister, moreover, the canister is put into the vessel body of the cask. Thus, radioactive substance can be contained in a shielded state.

Usually, the canister comprises a tubular vessel body closed at the bottom and a lid that closes a top opening of the vessel body. A basket is located in the vessel body, and a plurality of spent fuel assemblies are sealed in the vessel body in a manner such that they are supported by the basket. Normally, the spent fuel assemblies are sealed into the canister in the following processes.

First, the open-topped vessel body of the canister is immersed in cooling water and filled with the water. In this state, the basket and the spent fuel assemblies are contained in the vessel body. Thus, the spent fuel assemblies are temporarily shielded with the cooling water to prevent leakage of radiation.

Subsequently, a primary lid is dropped onto the top opening of the vessel body to close it, and a suitable quantity of water is discharged. Thereafter, the primary lid is welded to the vessel body to seal the top opening of the vessel body. After the water is completely discharged from the vessel body through a drainage hole in the primary lid, the drainage hole is sealed. Further, a secondary lid is lapped onto the primary lid and welded to the vessel body. Thus, the resulting canister has the spent fuel assemblies well sealed therein.

In the sealing process for the canister described above, the vessel body is filled with the cooling water as the primary lid is welded to it, in order to intercept radiation from the spent fuel assemblies. However, the welding operation takes so much time that the cooling water in the vessel body is heated by the spent fuel assemblies and evaporated gradually. The resulting steam fills the vessel body and flows out of it through the gap between the inner surface of the vessel body and the primary lid.

Normally, a welding operation is performed in a manner such that molten deposited metal naturally drops by the gravity, thereby forming penetration beads. As this is done, however, steam gets into the gap between the inner surface of the vessel body and the primary lid, as a welding portion, so that weld defects such as voids are inevitably formed in the welding portion. These weld defects lower the strength of the welding portion, and a radioactive substance leaks from the defective portions. Thus, it is hard to maintain the integrity or radioactive substance sealing performance of the canister.

BRIEF SUMMARY OF THE INVENTION

The present invention has been contrived in consideration of these circumstances, and its object is to provide a metallic closed vessel free from weld defects and high in sealability, a seal-welding method for the closed vessel, and an exhaust system used for the seal-welding method.

In order to achieve the above object, a closed vessel according to an aspect of the invention comprises: a substantially tubular vessel body closed at the bottom, having a top opening, and configured to contain radioactive substance; and a lid set in the top opening of the vessel body and welded to the inner peripheral surface of the vessel body.

The lid has an outer peripheral portion adjacently opposed to the inner peripheral surface of the vessel body, the outer peripheral portion including a welding portion welded to the inner peripheral surface of the vessel body and a space portion located on the bottom side of the vessel body with respect to the welding portion. The space portion is configured to be filled with a shield gas or to allow the flow of the shield gas therein so as to shield the welding portion from the interior of the vessel body, as the welding portion is welded.

A closed vessel according to another aspect of the invention comprises: a substantially tubular vessel body closed at the bottom, having a top opening, and configured to contain radioactive substance; a shielding plate set in the top opening of the vessel body and closing the top opening; a seal member for sealing a gap between the inner peripheral surface of the vessel body and the shielding plate; and a lid set in the top opening of the vessel body so as to be lapped on the shielding plate and having a peripheral edge portion welded to the inner peripheral surface of the vessel body. The lid has an outer peripheral portion adjacently opposed to the inner peripheral surface of the vessel body, the outer peripheral portion including a welding portion welded to the inner peripheral surface of the vessel body and a space portion located on the bottom side of the vessel body with respect to the welding portion. The space portion is configured to be filled with a shield gas or to allow the flow of the shield gas therein so as to shield the welding portion from the interior of the vessel body, as the welding portion is welded According to the closed vessel for a radioactive substance constructed in this manner, steam can be prevented from getting into the welding portion by filling into or running the shield gas through the space portion of the lid as the lid means is welded. Thus, the lid can be securely welded without involving any weld defects that are attributable to steam.

Since the gap between the shielding plate and the vessel body is sealed, moreover, steam can be more securely prevented from getting into the welding portion through the gap as the lid means is welded. In consequence, the lid means can be securely welded without involving any weld defects that are attributable to steam. Thus, the resulting closed vessel provides improved integrity and high radiation shielding properties.

A seal-welding method for a closed vessel configured to contain radioactive substance according to still another aspect of the invention comprises: filling water into a substantially tubular vessel body closed at the bottom and having a top opening; placing a radioactive substance in the vessel body and immersing the substance in the water; setting a lid in the top opening of the vessel body to close the top opening; evacuating the vessel body through a discharge hole formed in the lid and discharging steam generated in the vessel body to the outside, while charging air into the vessel body through the discharge hole; and welding a peripheral edge portion of the lid to the vessel body, thereby sealing the top opening of the vessel body, while discharging the steam to the outside.

A seal-welding method for a closed vessel according to a further aspect of the invention comprises: filling water into a substantially tubular vessel body closed at the bottom and having a top opening; placing a radioactive substance in the vessel body and immersing the substance in the water; setting a shielding plate in the upper end portion of the vessel body to close the top opening, and sealing a gap between the inner peripheral surface of the vessel body and the shielding plate by means of a seal member; setting a lid in the top opening of the vessel body to be lapped on the shielding plate, thereby closing the top opening; evacuating the vessel body through a discharge hole formed in the lid and the shielding plate and discharging steam generated in the vessel body to the outside, while charging air into the vessel body through the discharge hole; and welding the peripheral edge portion of the lid means to the vessel body, thereby sealing the top opening of the vessel body, while discharging the steam to the outside.

According to the seal-welding method for a closed vessel of the invention, moreover, the lid has an outer peripheral portion adjacently opposed to the inner peripheral surface of the vessel body, the outer peripheral portion including a welding portion welded to the inner peripheral surface of the vessel body and a space portion located on the bottom side of the vessel body with respect to the welding portion, and a shield gas is filled into or run through the space portion, thereby preventing the steam from getting into the welding portion, as the lid means is welded.

According to the seal-welding method for a closed vessel described above, the vessel body is evacuated to discharge steam as the lid is welded, whereby the steam can be prevented from getting into the welding portion. Thus, the lid can be securely welded without involving any weld defects.

Further, the steam can be more securely prevented from getting into the welding portion in a manner such that the shield gas is filled into or run through the space portion of the lid as the lid is welded. The resulting closed vessel enjoys high closeness and satisfactory radioactive substance sealing properties without involving any weld defects.

Furthermore, an exhaust system according to the invention comprises: a charging pipe configured to be passed through the discharge hole and having a charging port opening into the vessel body and a suction port opening to the outside of the vessel body; an exhaust pipe located in the charging pipe to form a double-pipe structure and having an exhaust port opening into the vessel body and an extending portion extending to the outside of the vessel body; and a suction device connected to the extending portion of the exhaust pipe and configured to evacuate the vessel body through the exhaust pipe and charge the open air into the vessel body through the charging pipe.

According to the exhaust system constructed in this manner, the vessel body can be simultaneously exhausted and charged by using the one discharge hole. More specifically, the air containing steam in the vessel body is discharged through the exhaust port by means of the suction device, and in concert with this, air is charged into the vessel body through the charging pipe, whereby the internal pressure of the vessel body is regulated. Thus, the steam that is generated in the vessel body can be discharged from the vessel body, so that a large quantity of steam can be prevented from getting into the welding portion. Even though radiation from the radioactive substance is intercepted by means of the water during the welding operation, therefore, satisfactory circumstances can be enjoyed without involving any voids in the welding portion, and improvement of the welding accuracy can be expected.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently embodiments of the invention, and together with the general description given above and the detailed description of the embodiments given below, serve to explain the principles of the invention.

DETAILED DESCRIPTION OF THE INVENTION

A canister according to a first embodiment of the present invention will now be described in detail with reference to the accompanying drawings.

Figure 1:
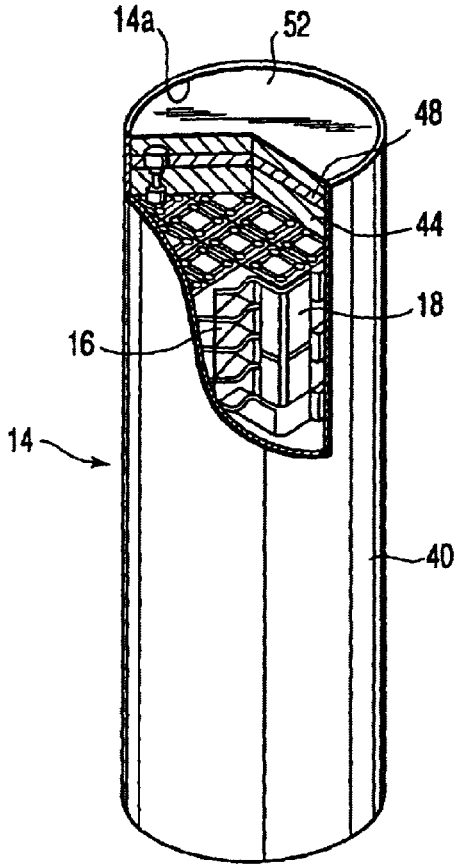
FIG. 1 is a cutaway perspective view showing a canister according to a first embodiment of the invention.
Figure 2:
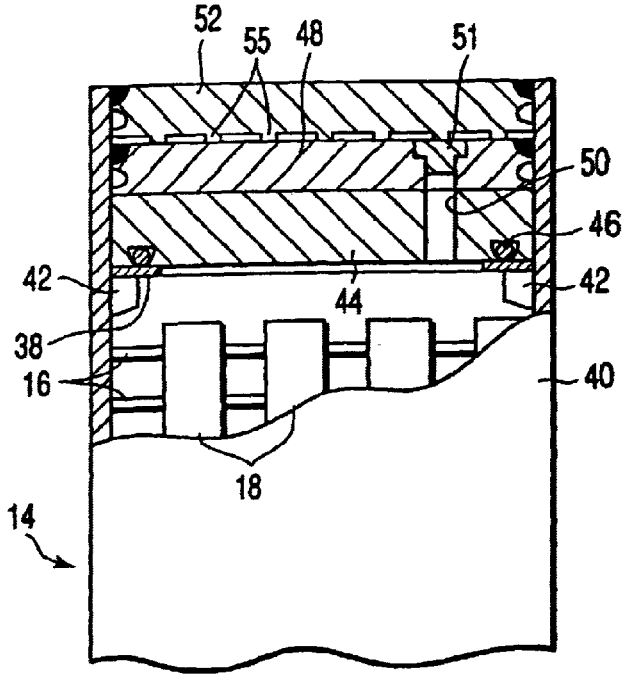
FIG. 2 is a cutaway side view showing the upper end portion of the canister.

As shown in FIGS. 1 and 2, a canister 14 for use as a metallic closed vessel comprises a substantially cylindrical vessel body 40 that is closed at the bottom and has a top opening 14*a*. The vessel body 40 is formed of a metal such as stainless steel. A plurality of spent fuel assemblies 18 are sealed in the vessel body 40 in a manner such that they are supported by a basket 16. These spent fuel assemblies 18 are formed of a spent fuel from a reactor, for example, and contain a radioactive substance that involves heat release attributable to decay heat and generation of radiation. The canister 14 has a weld-sealed structure to prevent the contained radioactive substance leaking out.

More specifically, a plurality of support blocks 42, e.g., four in number, are fixed on the inner peripheral surface of the upper end portion of the vessel body 40. The support blocks 42 are arranged at equal spaces in the circumferential direction. A ring-shaped support plate 38 is placed on the support blocks 42. The support plate 38 has an outside diameter substantially equal to the inside diameter of the vessel body 40.

A disc-shaped shielding plate 44 is placed on the support plate 38, thereby closing the top opening of the vessel body 40. A groove is formed on the outer peripheral portion of the lower surface of the shielding plate 44, covering the whole circumference. Fitted in this groove is an O-ring 46 of a heat-resistant elastic material, such as ceramics, for use as a seal member. The O-ring 46 is in intimate contact with the upper surface of the support plate 38, and airtightly closes the gap between the inner peripheral surface of the vessel body 40 and the shielding plate 44.

A disc-shaped primary lid 48 is lapped on the shielding plate 44 in the top opening of the vessel body 40, thereby closing the top opening of the vessel body. The topside part of the outer peripheral portion of the primary lid 48 is welded to the inner peripheral surface of the vessel body 40, covering the whole circumference. The shielding plate 44 and the primary lid 48 are formed having a discharge hole 50, which is used to discharge air and water form the vessel body 40 and feed air into the vessel body, as mentioned later. The discharge hole 50 is sealed by means of a plug 51 that is fixed to the primary lid 48. Further, a groove is formed covering the whole circumference of the outer peripheral portion of the primary lid 48, and is situated below a welding portion. This groove defines a space in which a shielding gas is filled or run during welding operation, as mentioned later.

A disc-shaped secondary lid 52 is lapped on the primary lid 48 in the top opening of the vessel body 40. The peripheral edge portion of the topside of the secondary lid 52 is welded to the inner peripheral surface of the vessel body 40. Thus, the secondary lid 52 closes the top opening of the vessel body 40. The secondary lid 52 has a plurality of protrusions 55 on its lower surface, which are directly in contact with the upper surface of the primary lid 48.

Thus, the top opening 14*a* of the vessel body 40 is airtightly closed by the shielding plate 44, primary lid 48, and secondary lid 52. The shielding plate 44, primary lid 48, and secondary lid 52 are formed of a metal such as stainless steel. A gas such as helium is sealed under a given pressure in a closed space between the primary and secondary lids 48 and 52.

The following is a description of a method for loading the spent fuel assemblies 18 into the canister 14 constructed in this manner and a seal-welding method for the lids of the canister.

Figure 3:
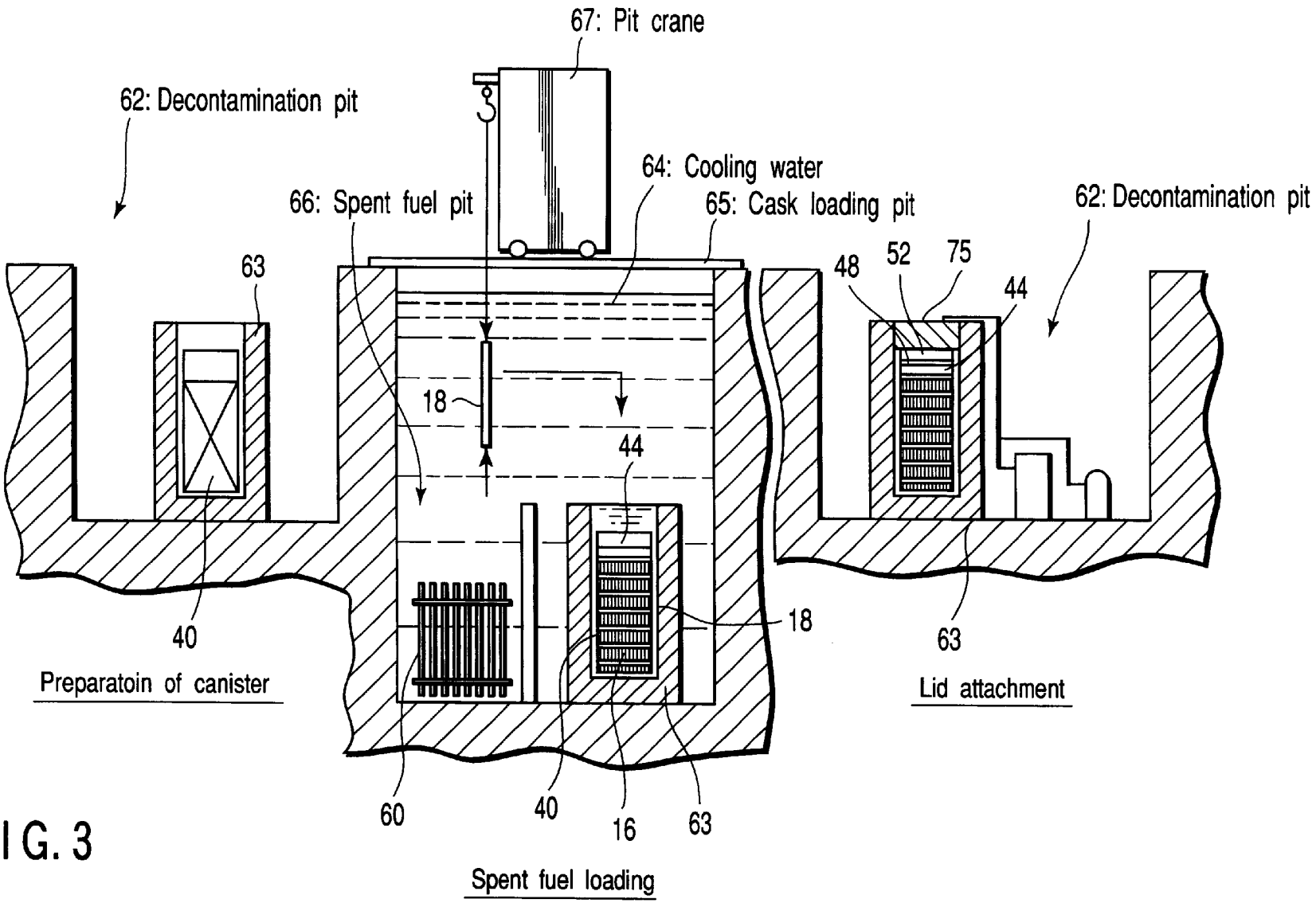
FIG. 3 is a view schematically showing a spent fuel loading process for the canister and a lid welding process.

In a decontamination pit 62, as shown in FIG. 3, the vessel body 40 of the canister 14 is put into a transportation cask 63 in a manner such that its upper end is open, whereupon preparations are made for fuel loading. The basket 16 is set in advance in the vessel body 40. Subsequently, the transportation cask 63, having the vessel body 40 therein, is transferred to a cask loading pit 65 filled with cooling water 64 by of an overhead traveling crane (not shown), and is immersed in the cooling water.

In the cask loading pit 65, the spent fuel assemblies 18, having so far been contained in a spent fuel rack 60 in a spent fuel pit 66, are pulled out one after another by means of a pit crane 67 and loaded in succession into the basket 16 in the vessel body 40. After a given number of spent fuel assemblies 18 are loaded into the vessel body 40, the support plate 38 and the shielding plate 44 are fitted successively into the top opening of the vessel body 40.

Subsequently, the transportation cask 63 is pulled up from the cask loading pit 65 and transferred to the decontamination pit 62 by the overhead traveling crane. In the decontamination pit 62, a suitable quantity of cooling water is discharged from the vessel body 40 so that the surface of the cooling water 64 is situated slightly above the spent fuel assemblies 18. Thereafter, the primary lid 48 is welded to the vessel body 40, and complete dehydration, vacuum drying, inert gas replacement, sealing operation, and air leakage inspection are carried out. Further, the secondary lid 52 is welded, and inert gas replacement in the space between the primary and secondary lids 48 and 52, sealing operation, and air leakage inspection are carried out. Thus, seal-welding operation for the lids of the canister is finished, whereupon the canister is completed containing the spent fuel.

Thereafter, the top opening of the cask 63 is closed by means of a lid 75, and a pre-transportation check is conducted, whereupon pre-shipment preparations are completed. Then, the transportation cask 63, thus containing the canister 14, is transported from a power plant to a storage facility.

The following is a detailed description of a seal-welding method for the lids of the canister 14.

Figure 4:
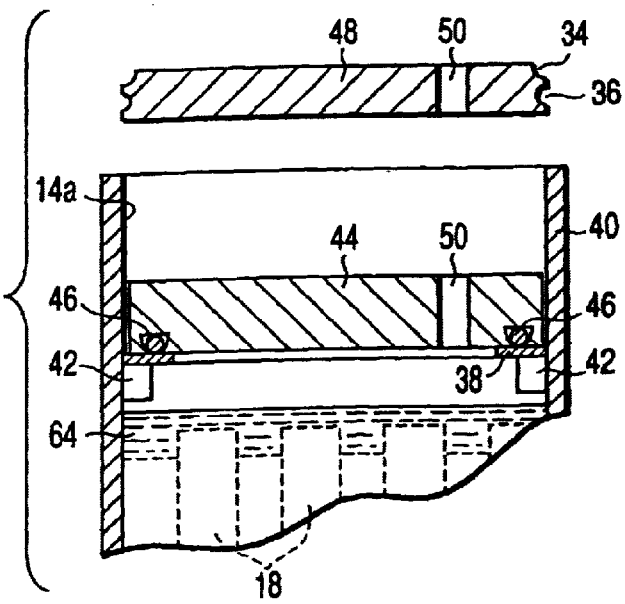
FIG. 4 is a sectional view showing a mounting process for a shielding plate and a primary lid of the canister.

After the support blocks 42 and the shielding plate 44 are mounted in the top opening of the vessel body 40 and a suitable quantity of the cooling water 64 is discharged, as mentioned before, the primary lid 48 is fitted into the top opening of the vessel body, as shown in FIG. 4. Since the O-ring 46 is provided on the outer periphery of the lower surface of the shielding plate 44 so as to be in intimate contact with the support plate 38, as mentioned before, the gap between the shielding plate 44 and the inner surface of the vessel body 40 is sealed with respect to the interior of the vessel body by the O-ring.

Figure 5:
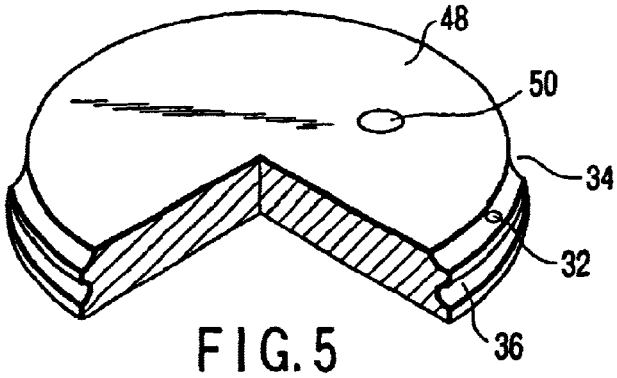
FIG. 5 is a cutaway perspective view showing a primary lid of the canister.
Figure 6:
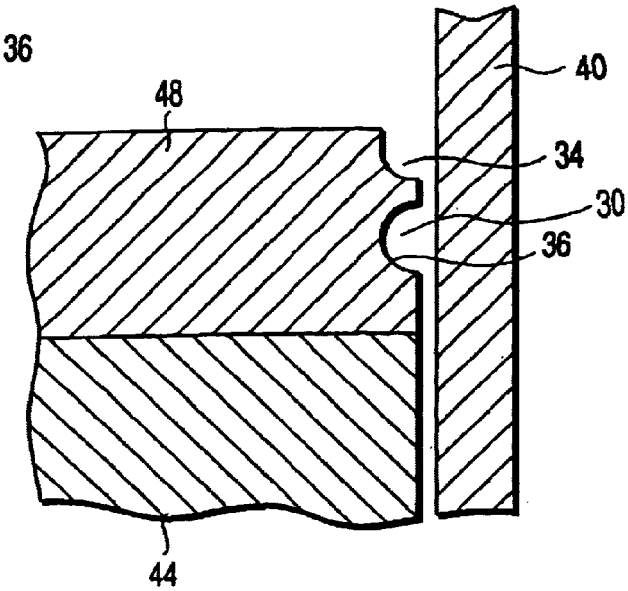
FIG. 6 is an enlarged sectional view showing the outer peripheral portion of the primary lid.

As shown in FIGS. 4 to 6, moreover, the upper end part of the outer peripheral portion of the primary lid 48 forms a welding portion 34, and a groove 36 is formed extending throughout the circumference under the welding portion, that is, on the lower end side of the vessel body 40 as compared with the welding portion. Further, the outer peripheral portion of the primary lid 48 is formed having charging holes 32 that communicate with the groove 36 and open in the upper surface of the lid 48. The holes 32, e.g., two in number, are spaced in the circumferential direction of the primary lid 48.

The outer peripheral portion of the primary lid 48 set in place is adjacently opposed to the inner peripheral surface of the vessel body 40, and the groove 36 defines a substantially closed annular space 30 under the welding portion 34.

Figure 7:
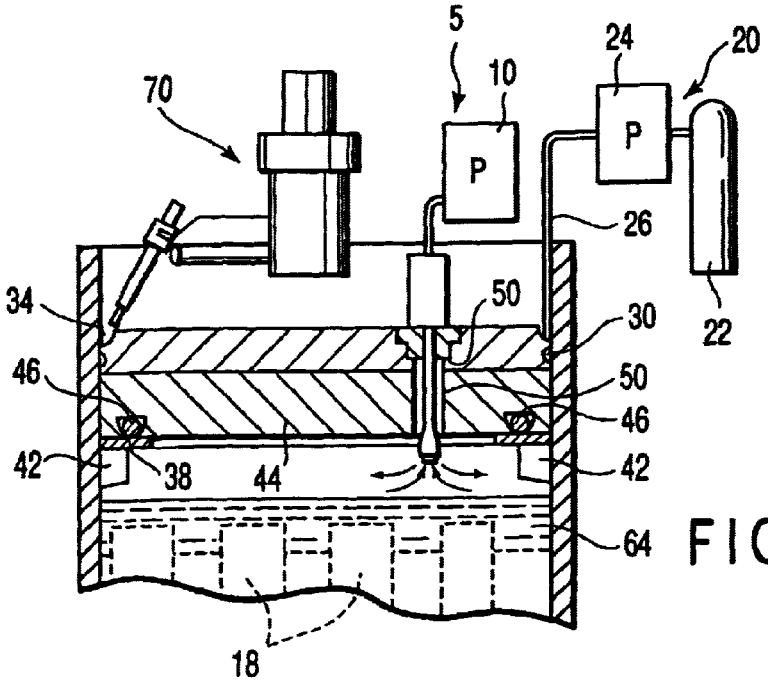
FIG. 7 is a sectional view showing a process for welding the primary lid of the canister.

After the primary lid 48 is set in place, as shown in FIG. 7, its topside peripheral edge portion is welded stepwise to the inner peripheral surface of the vessel body 40 by a welding device 70. In order to intercept radiation from the spent fuel assemblies 18, the vessel body 40 is kept filled with the cooling water 64 during this welding operation. Since welding the primary lid 48 takes a lot of time, the cooling water 64 in the vessel body 40 is heated and gradually evaporated by means of heat from the spent fuel assemblies 18 during the welding operation. The resulting steam is urged to flow out toward the top opening of the vessel body 40 through the gap between the inner peripheral surface of the vessel body and the primary lid 48. Since the gap between the inner peripheral surface of the vessel body 40 and the primary lid 48 is closed by the O-ring 46, however, the quantity of steam that flows into the gap can be reduced considerably. Thus, the primary lid 48 can be welded without involving any weld defects that are attributable to steam.

In performing the welding operation, according to the present embodiment, moreover, an exhaust system 5 (mentioned later) is set by utilizing the discharge hole 50 of the shielding plate 44 and the primary lid 48, and a shield gas supply device 20 is connected to one of the charging holes 32 of the primary lid 48. The primary lid 48 is welded by a welding device 70 in a manner such that the steam generated in the vessel body 40 is discharged from the vessel body and that a shield gas is run through the space 30, which is defined by the groove 36 of the support plate 38, by means of the shield gas supply device 20.

Figure 8:
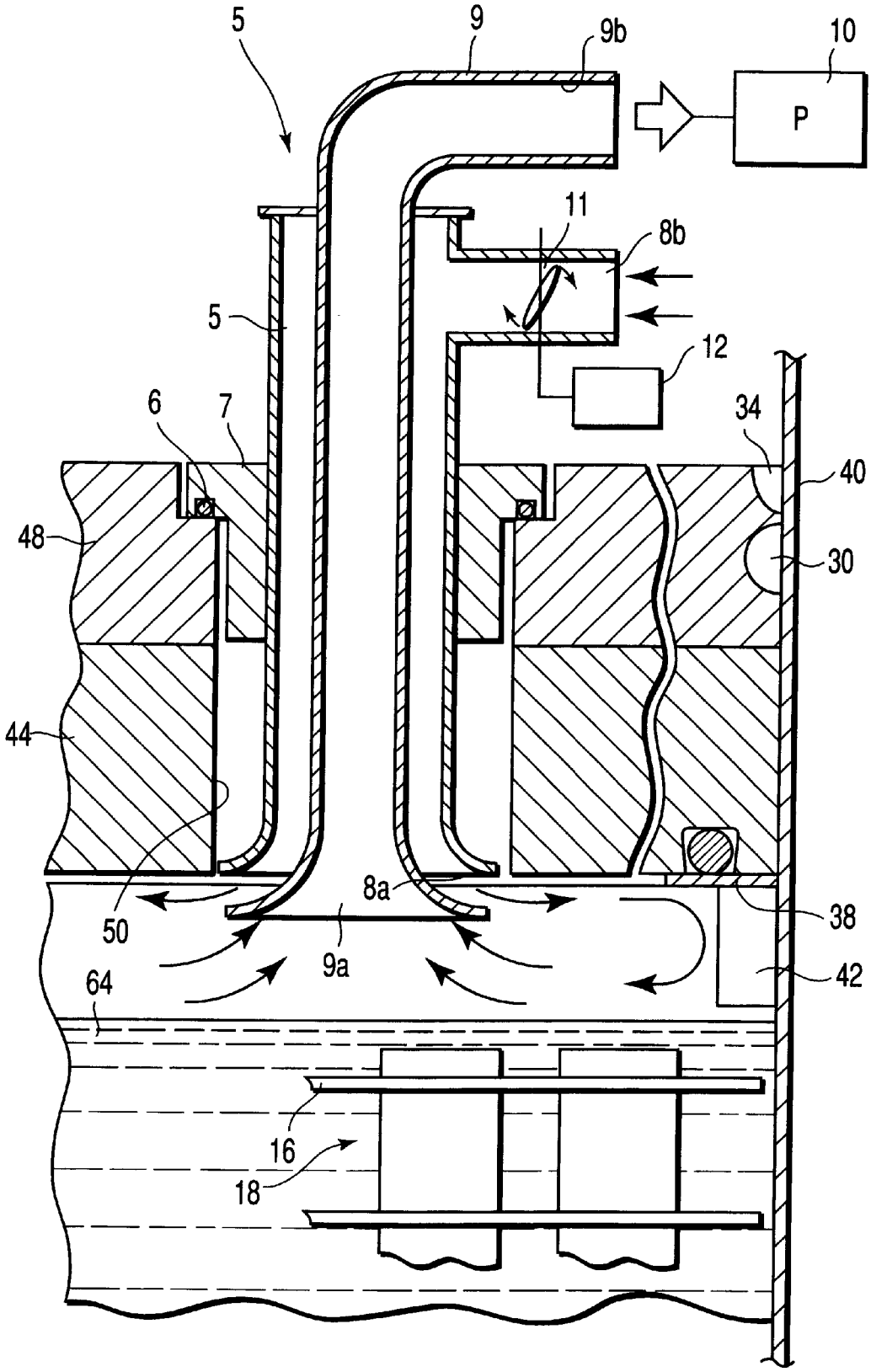
FIG. 8 is a side view showing an exhaust system used in welding the lid means of the canister.

The following is a description of the exhaust system 5. As shown in FIG. 8, the exhaust system 5 is provided with a charging pipe 8 and an exhaust pipe 9. The charging pipe 8 can be passed through the discharge hole 50 of the primary lid 48 and the shielding plate 44. The exhaust pipe 9 forms a double-pipe structure such that it is substantially coaxially located in the charging pipe 8. The charging pipe 8 has a charging port 8*a*, which opens into the vessel body 40 when the pipe 8 is passed through the discharge hole 50, and a suction port 8*b*, which opens to the outside of the vessel body. The exhaust pipe 9 has an exhaust port 9*a*, which opens into the vessel body 40, and an extending portion 9*b*, which extends to the outside of the vessel body. The charging port 8*a* of the charging pipe 8 and the exhaust port 9*a* of the exhaust pipe 9 are trumpet-shaped and substantially coaxial with each other.

A ring-shaped adapter 7 having a flange is fixed to the outer periphery of the charging pipe 8. The discharge hole 50 can be airtightly closed with the charging pipe 8 passed through the discharge hole 50 and with the adapter 7 fitted tight in the discharge hole of the primary lid 48 through a load beam 6.

Further, the exhaust system 5 is provided with a suction pump 10 that is connected to the extending portion 9*b* of the exhaust pipe 9. The pump 10 serves as suction means that evacuates the vessel body 40 through the exhaust pipe 9 and charges the open air into the vessel body through the charging pipe 8. Further, the exhaust system 5 is provided with a butterfly valve 11 located near the suction port 8*b* in the charging pipe 8 and a flow regulating portion 12, which adjusts the opening of the valve 11, thereby regulating the quantity of air charged into the vessel body 40.

During the welding operation, the suction pump 10 of the exhaust system 5 is actuated to discharge air, which contains the steam generated in the vessel body 40, through the exhaust port 9*a* of the exhaust pipe 9. Thereupon, the open air is fed into the vessel body 40 through the charging pipe 8. In doing this, the internal pressure of the vessel body 40 is controlled by adjusting the opening of the butterfly valve 11 in the charging pipe 8 by the flow regulating portion 12, thereby regulating the air charge. Thus, the steam generated in the vessel body 40 can be efficiently discharged from the vessel body and securely prevented from flowing into the welding portion 34 of the primary lid 48.

As shown in FIG. 7, on the other hand, the shield gas supply device 20 comprises a containing tank 22, a gas supply pipe 26, and a pump 24. The tank 22 contains an inert gas such as argon for use as the shield gas. The pipe 26 is connected to the charging holes 32 of the primary lid 48. The pump 24 supplies the shield gas in the containing tank 22 to the holes 32 through the gas supply pipe 26.

During the welding operation, the shield gas supply device 20 supplies the shield gas to the space 30 under the welding portion 34 of the primary lid 48, thereby filling the space 30 with the shield gas or causing the shield gas to flow. With use of the shield gas, therefore, the steam that is urged to flow into the welding portion 34 can be cut off, so that it can be more securely prevented from flowing into the welding portion 34.

Figure 9:
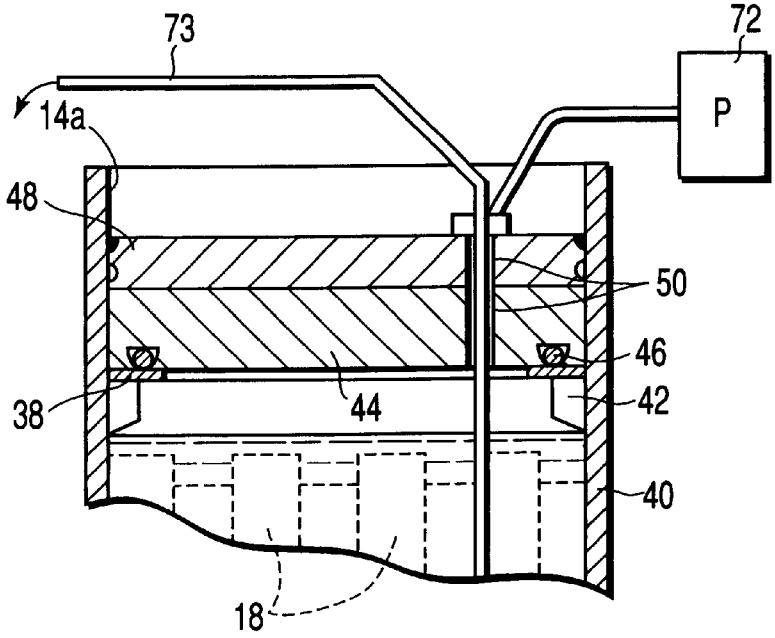
FIG. 9 is a sectional view showing a process for draining cooling water from a vessel body in a sealing process for the canister.

After the primary lid 48 is welded by the method described above, water in the vessel body 40 is discharged. In this case, as shown in FIG. 9, for example, the vessel body 40 is pressurized inside through the discharge hole 50 of the primary lid 48 and the shielding plate 44 by a pressure pump 72, and the water in the vessel body is discharged to the outside by a drain pipe 73 that is inserted in the vessel body through the discharge hole 50.

Subsequently, vacuum drying of the interior of the vessel body 40, inert gas replacement, sealing operation, and air leakage inspection are carried out, and the discharge hole 50 of the primary lid 48 is then sealed by means of the plug 51, as shown in FIG. 2. Thereafter, the secondary lid 52 is set in the top opening of the vessel body 40 so as to be lapped on the primary lid 48. Then, the peripheral edge portion of the secondary lid 52 is welded to the inner peripheral surface of the vessel body 40 by the welding device 70. Thereafter, inert gas replacement, sealing operation, and air leakage inspection are carried out for the space between the primary and secondary lids 48 and 52, whereupon the seal-welding operation for the lids of the canister 14 terminates.

According to the canister 14 constructed in this manner and the seal-welding method for its lids, the gap between the shielding plate 44 and the vessel body 40 is closed by the O-ring 46. In welding the primary lid 48, therefore, steam can be prevented from flowing into the welding portion through the gap. In consequence, the primary lid 48 can be securely welded without involving any weld defects that are attributable to steam. Thus, the resulting canister provides improved integrity and high radiation shielding properties.

As the primary lid 48 is welded, moreover, the vessel body 40 is evacuated by means of the exhaust system 5 and steam is discharged. By doing this, steam can be more securely prevented from getting into the welding portion, so that the primary lid can be welded with higher reliability.

According to the exhaust system 5 constructed in this manner, the vessel body 40 can be simultaneously exhausted and charged by using the one discharge hole 50. More specifically, the air containing steam in the vessel body 40 is discharged through the exhaust port 9*a* by the suction pump 10, and together with this, air is charged into the vessel body through the charging pipe 8, whereby the internal pressure of the vessel body is regulated. Thus, the steam that is generated in the vessel body 40 can be efficiently discharged from the vessel body, so that a large quantity of steam can be prevented from getting into the welding portion. Even though radiation from the spent fuel assemblies 18 is intercepted by the cooling water 64 during the welding operation, therefore, satisfactory circumstances can be enjoyed without involving any voids in the welding portion, and improvement of the welding accuracy can be expected.

According to this embodiment, moreover, steam can be more securely prevented from getting into the welding portion in a manner such that the shield gas is filled into or run through the space 30 in the outer peripheral portion of the primary lid 48 as the primary lid is welded. The resulting canister provides high integrity and satisfactory radiation shielding properties without involving any weld defects.

Although the discharge of steam by means of the exhaust system 5 and the interception of steam by means of the shield gas are carried out simultaneously according to the embodiment described above, only one of these operations may be performed with the same effect. In this case, the resulting canister also provides high integrity without involving any weld defects that are attributable to steam.

Figure 10:
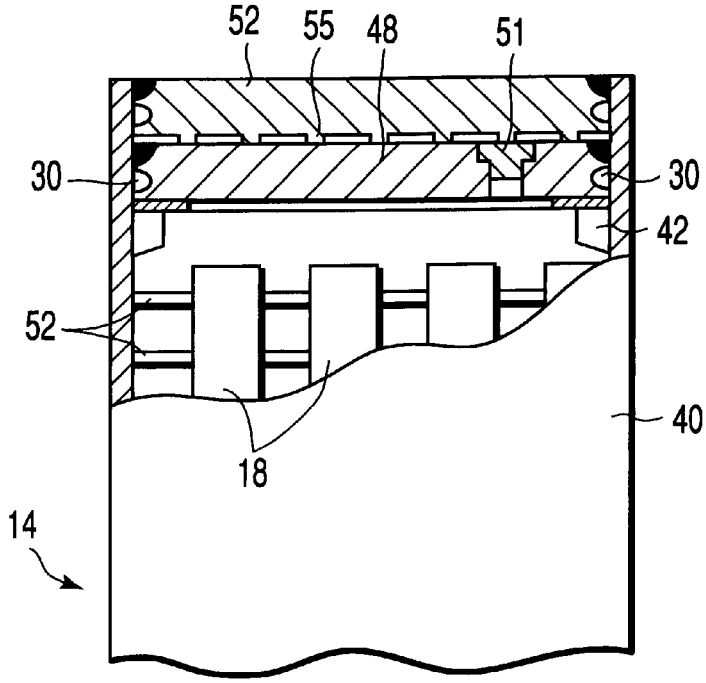
FIG. 10 is a sectional view showing the principal part of a canister according to a second embodiment of the invention.

The following is a description of a canister 14 according to a second embodiment of the invention. According to the second embodiment, as shown in FIG. 10, the top opening of a vessel body 40 is closed by a primary lid 48 and a secondary lid 52 only, and a shielding plate 44 is omitted. Since the second embodiment shares other configurations with the first embodiment, like reference numerals are used to designate like portions, and a detailed description of those portions is omitted.

In a seal-welding method for the primary lid 48 according to the second embodiment, as in the case of the first embodiment, the topside peripheral edge portion of the primary lid is welded stepwise by the welding device with spent fuel assemblies 18 immersed in cooling water. In doing this, the exhaust system 5 is used to discharge steam in the vessel body 40 to the outside, and the shield gas supply device 20 is used to fill into or run the shield gas through a space 30 in the outer peripheral portion of the primary lid 48.

Also in the second embodiment, therefore, steam can be prevented from flowing into the welding portion as the primary lid 48 is welded, so that the primary lid 48 can be securely welded without involving any weld defects that are attributable to steam. Thus, the resulting canister enjoys improved radiation shielding properties.

Also in the second embodiment, moreover, only one of the operations for discharging steam by means of the exhaust system 5 and intercepting steam by means of the shield gas may be carried out with the same effect. In this case, steam can be prevented from reaching the welding portion, and therefore, generation of weld defects can be prevented. Thus, the resulting canister provides high shielding properties.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

For example, the seal member used in the first embodiment is not limited to the O-ring, and may be selected from various elements as required. It may, for example, be a metal wire, sealing tape, heat-resistant tube, or heat-resistant paste.

What is claimed is:

1. A closed vessel for a radioactive substance, comprising:

a substantially tubular vessel body closed at the bottom, having a top opening, and configured to contain radioactive substance in a shielded state; and a lid set in the top opening of the vessel body and welded to the inner peripheral surface of the vessel body, the lid having an outer peripheral portion adjacently opposed to the inner peripheral surface of the vessel body, the outer peripheral portion including a welding portion welded to the inner peripheral surface of the vessel body and a groove formed on the outer peripheral portion throughout the circumference and defining a space portion which is located toward the bottom side of the vessel body with respect to the welding portion and which faces the inner peripheral surface of the vessel body, the space portion being configured to be filled with a shield gas or to allow the flow of the shield gas therein so as to shield the welding portion from the interior of the vessel body, as the welding portion is welded.

2. A closed vessel for a radioactive substance according to claim 1, wherein the lid has a discharge hole through which air is simultaneously charged into and discharged from the vessel body as the welding portion is welded.

3. A closed vessel for a radioactive substance, comprising:

a substantially tubular vessel body closed as the bottom, having a top opening, and configured to contain radioactive substance in a shielded state;

a shielding plate set in the top opening of the vessel body and closing the top opening;

a seal member for sealing a gap between the inner peripheral surface of the vessel body and the shielding plate; and a lid set in the top opening of the vessel body so as to be lapped on the shielding plate and having a peripheral edge portion welded to the inner peripheral surface of the vessel body, the lid having an outer peripheral portion adjacently opposed to the inner peripheral surface of the vessel body, the outer peripheral portion including a welding portion welded to the inner peripheral surface of the vessel body and a groove formed on the outer peripheral portion throughout the circumference and defining a space portion which is located toward the bottom side of the vessel body with respect to the welding portion and which faces the inner peripheral surface of the vessel body, the space portion being configured to be filled with a shield gas or to allow the flow of the shield gas therein so as to shield the welding portion from the interior of the vessel body, as the welding portion is welded.

4. A closed vessel for a radioactive substance according to claim 3, wherein the lid and the shielding plate have a discharge hole through which air is simultaneously charged into and discharged from the vessel body as the welding portion is welded.

5. A closed vessel for a radioactive substance according to claim 3, which further comprises a support portion located on the inner peripheral surface of the vessel body near the top opening and a frame-shaped support plate placed on the support portion, and wherein the shielding plate is placed on the support plate, and the seal member has an O-ring provided between the shielding plate and the support plate.

* * * * *